US009191996B2

(12) United States Patent
Miyamoto

(10) Patent No.: US 9,191,996 B2
(45) Date of Patent: Nov. 17, 2015

(54) HEATER APPARATUS

(75) Inventor: Satoshi Miyamoto, Osaka (JP)

(73) Assignee: SHARP KABUSHIKI KAISHA, Osaka-shi (JP)

( * ) Notice: Subject to any disclaimer, the term of this patent is extended or adjusted under 35 U.S.C. 154(b) by 737 days.

(21) Appl. No.: 13/518,477

(22) PCT Filed: Dec. 24, 2010

(86) PCT No.: PCT/JP2010/073327

§ 371 (c)(1),
(2), (4) Date: Jun. 22, 2012

(87) PCT Pub. No.: WO2011/078320

PCT Pub. Date: Jun. 30, 2011

(65) Prior Publication Data

US 2012/0260690 A1 Oct. 18, 2012

(30) Foreign Application Priority Data

Dec. 24, 2009 (JP) ..... 2009-291755

(51) Int. Cl.
*H05B 3/02* (2006.01)
*F25D 21/08* (2006.01)
*H05B 1/02* (2006.01)

(52) U.S. Cl.
CPC ..... *H05B 1/0227* (2013.01); *F25D 21/08* (2013.01)

(58) Field of Classification Search
CPC ..... H05B 1/0227; H05B 3/02; H05B 1/00; H05B 1/02; H05B 7/00; H05B 7/005; F25D 21/08
USPC ..... 62/275; 219/201, 539
See application file for complete search history.

(56) References Cited

U.S. PATENT DOCUMENTS

| | | | | |
|---|---|---|---|---|
| 3,945,217 | A * | 3/1976 | Bashark | 62/151 |
| 5,189,888 | A * | 3/1993 | Anderson et al. | 62/248 |
| 6,324,853 | B1 * | 12/2001 | Kelly et al. | 62/80 |
| 6,550,261 | B1 * | 4/2003 | Shima et al. | 62/176.1 |
| 6,619,058 | B2 * | 9/2003 | Cho et al. | 62/156 |
| 6,644,051 | B1 * | 11/2003 | Cho et al. | 62/186 |
| 6,755,044 | B1 * | 6/2004 | Hildebrandt | 62/276 |
| 6,779,357 | B1 * | 8/2004 | Fann | 62/285 |
| 6,817,195 | B2 * | 11/2004 | Rafalovich et al. | 62/155 |
| 6,830,661 | B1 * | 12/2004 | Land | 202/83 |
| 6,862,891 | B2 * | 3/2005 | Devos | 62/80 |
| 6,964,172 | B2 * | 11/2005 | Dudley et al. | 62/80 |
| 8,087,261 | B2 * | 1/2012 | Lee et al. | 62/407 |

FOREIGN PATENT DOCUMENTS

| | | |
|---|---|---|
| JP | 53-63754 U | 5/1978 |
| JP | 61-20328 U | 12/1986 |

(Continued)

*Primary Examiner* — Mohammad M Ali
(74) *Attorney, Agent, or Firm* — Birch, Stewart, Kolasch & Birch, LLP

(57) ABSTRACT

A heater apparatus divides a heater capacity (heater wire), connects the divided heater wire portions to each other outside the a heat insulating layer, changes a connection mode irrespective of which of a 100 V system or a 200 V system is used as a supply voltage, and thereby suppresses a heater temperature to within a safe range even in a continuous current conduction mode, and uses a common heater and suppress management cost. Furthermore, since the heater wire portions are connected to each other outside the heat insulating layer for the heater embedded in the heat insulating layer of a refrigerator, the heater apparatus is capable of reducing production loss due to misconnections and using a common heater.

2 Claims, 3 Drawing Sheets

(56) References Cited

FOREIGN PATENT DOCUMENTS

| | | | |
|---|---|---|---|
| JP | 4-64007 | U | 6/1992 |
| JP | 6-124765 | A | 5/1994 |
| JP | 6-62932 | U | 9/1994 |
| JP | 11-201620 | A | 7/1999 |

* cited by examiner

HEATER APPARATUS

TECHNICAL FIELD

The present invention relates to a heater apparatus used for an electric apparatus such as a refrigerator.

BACKGROUND ART

A refrigerator is generally constructed of an inner box formed through vacuum molding, metal outer walls outside the inner box, wall surfaces surrounding three sides of a storeroom of the refrigerator with a urethane foam heat insulator injected and made to foam in a space formed between the inner box and the metal outer wall, and a door provided in an opening of the storeroom in a freely openable/closable manner with its interior also filled with a urethane foam heat insulator.

Furthermore, many electrical components such as various temperature sensors for detecting temperatures of various storerooms provided in the refrigerator and detecting completion of defrosting, a fan that blows air to the respective storerooms, a damper for adjusting the amount of cold air blow are arranged in the refrigerator and these electrical components are connected to a control substrate set up outside the refrigerator via lead wires.

Furthermore, the refrigerator uses heaters for temperature compensation inside the refrigerator, for prevention of condensation, for prevention of freezing, for defrosting or the like (e.g., see Patent Literature 1). These heaters are connected to the control substrate outside the refrigerator via lead wires in a heat insulating layer. Furthermore, the condensation prevention heater and storeroom temperature compensation heater are arranged on the urethane heat insulating layer side from the standpoint of securing an accommodation volume and safety such as preventing the heaters from contacting people.

CITATION LIST

Patent Literature

Patent Literature 1: Japanese Utility Model Laid-Open No. 61-203285

SUMMARY OF INVENTION

Technical Problem

Since a supply voltage of a refrigerator varies depending on its destination (country), heaters specific to their respective supply voltages are used, but heaters are preferably standardized using same exterior parts so as to cover a broader range of destinations.

Furthermore, condensation prevention heaters and storeroom temperature compensation heaters are preferably standardized so that the same heaters can be used for different models of refrigerators in order to reduce management cost and eliminate production loss due to misconnections among different models caused by providing different types of heaters for different models of refrigerators.

In the case of a refrigerator, it is difficult to replace a heater arranged in a heat insulating layer after urethane foaming. Therefore, if heaters are misconnected, the heaters are totally wasted and production loss is great. For example, a temperature compensation heater for a vegetable room, a freezing prevention heater of a water supply tank and a condensation prevention heater on the mating surface of the refrigerator door are attached before urethane foaming, but once urethane of the cabinet or door is foamed, it is difficult to extract the heaters unless the cabinet or door is destroyed.

Furthermore, an identical heater is preferably used commonly for heaters for temperature compensation, freezing prevention, condensation prevention or the like, but since the heating value differs depending on the use, to realize standardization, it is necessary to assume a current conduction time and a current interruption time as one cycle, adjust the current conduction rate which is the ratio of the current conduction time in the one cycle through an adjustment mechanism and adjust the heating value of the heater. However, should the current conduction rate adjustment mechanism of the heater fail, the current may be continuously applied to the heater and exceed its safe temperature range.

Therefore, a heater to be shared is intended for extremely limited use. A freezing prevention heater for a water supply tank or a condensation prevention heater for the refrigerator door in particular has a small heater size and it is impossible to suppress the wattage density of heater wires (referring to a value obtained by dividing the heater capacity (wattage) by the heater surface area, that is, wattage per unit area or value obtained by dividing the heater capacity (wattage) by the length of the heater wire) to within a safe range.

Furthermore, a heater may be shared using a voltage divider circuit or using a transformer to transform its voltage as described in Patent Literature 1, but these methods not only result in high cost but also require extra space for installation of the transformer or the like, which becomes a demerit.

In view of the above-described problems, it is an object of the present invention to provide a heater apparatus capable of sharing a heater in an electric apparatus such as a refrigerator.

Solution to Problem

In order to attain the above described object, the present invention provides a heater apparatus provided with a heater including a heater wire that is incorporated in an exterior member, wherein the heater wire of the heater is divided into a plurality of heater wires and the divided heater wire portions are connected together outside the exterior member according to a supply voltage.

According to the above-described configuration, the heater wire of the heater (heater capacity) is divided and the divided heater wire portions are connected together outside the exterior member, and it is thereby possible to change the heater wire connection mode according to a supply voltage specification to change a heating value of the heater, and thereby suppress the heater temperature to within a safe range even in continuous current conduction mode. Therefore, it is possible to use a common heater when the supply voltage specification is any one of a 100 V system (100 V to 127 V) and a 200 V system (200 V to 240 V) and suppress management cost. Furthermore, since a common heater can be used for both supply voltage specifications, it is possible to eliminate the necessity for destroying the exterior member due to misconnections of the heaters and reduce production loss.

The exterior member includes all kinds of electric apparatus incorporating a heater. The present invention is preferably applicable to an exterior member which has an embedded heater that cannot be removed without destruction in particular. For example, the present invention is preferably applicable to an electric apparatus in which a heater is embedded in an exterior member made up of a urethane heat insulating layer. Examples of such an electric apparatus include refrigerators, hot carpets and floor heating appliances.

Furthermore, examples of the method of changing the mode in which the heater wires are connected outside the exterior member according to the supply voltage specification include parallel connection or series connection of the divided heater wire portions. For example, the divided heater wire portions may be connected each other in parallel in the case of a power supply voltage 100 V system and the divided heater wire portions may be connected each other in series in the case of a 200 V system to thereby suppress heating values of the respective heater wires.

As an aspect of external connection between the heater wires, a control substrate that controls the heater is used. That is, a wiring pattern constituting part of the electric circuit of the heater is formed on the control substrate and the heater wires are connected together in parallel or in series using this wiring pattern.

As a preferred embodiment, a first control substrate having a wiring pattern in which heater wires are connected in parallel and a second control substrate having a wiring pattern in which heater wires are connected in series may be prepared, and the choice of which control substrate to use may be determined according to the supply voltage specification.

In the heater apparatus in which heater wires are connected in parallel, the first control substrate that drives and controls the heater is provided outside the exterior member, a wiring pattern for connecting a plurality of heater wires in parallel is formed on the first control substrate, end lead wires connected to both ends of the heater wire and an intermediate lead wire for connecting the divided heater wire portions outside the heater are led out of the exterior member, and also connected to a connection section of the first control substrate and the divided heater wire portions are connected each other in parallel.

In the heater apparatus in which heater wires are connected in series, the second control substrate that drives and controls the heater is provided outside the exterior member, a wiring pattern for connecting a plurality of heater wires in series is formed on the second control substrate, end lead wires connected to both ends of the heater wire and an intermediate lead wire for connecting the divided heater wire portions outside the heater are led out of the exterior member, and also connected to a connection section of the second control substrate and the divided heater wire portions are connected in series.

Connecting the heater on the first control substrate or the second control substrate in this way provides an advantage that the heater connection mode is automatically determined if a predetermined control substrate (first control substrate or second control substrate) is prepared and lead wires from the heater are attached thereto without being aware of (managing) whether a heater circuit connected is connected in parallel or in series during production/assembly.

Furthermore, in the heater apparatus in which the heater wires are connected in parallel and the heater apparatus in which the heater wires are connected in series, a change section that changes the current conduction rate of the heater is provided outside the exterior member and the heating value of the heater is adjusted through the change section.

Irrespective of whether the supply voltage is, for example, a specification of 100 V to 127 V (100 V system) or a specification of 200 V to 240 V (200 V system), the heating value can be adjusted within these ranges by the change section changing the current conduction rate of the heater.

In particular, the heater apparatus in the above configuration can be assembled into a refrigerator provided with a heat insulating box that includes a heat insulating layer of urethane foam or the like filling a space formed of an inner box and an outer wall and uses the interior of the inner box as a storeroom. That is, the heater apparatus is applicable to a refrigerator in which the heater of the heater apparatus is embedded in a heat insulating layer and divided heater wire portions are connected together outside the heat insulating layer according to a supply voltage.

It is thereby possible to make connections according to the power supply voltage specification outside the heat insulating layer by switching the control substrate even after urethane foaming and suppress production loss.

As a method of assembling a heater apparatus into a refrigerator, a method is provided for a refrigerator provided with a heat insulating box that includes a heat insulating layer of urethane foam or the like filling a space formed of an inner box and an outer wall and uses the interior of the inner box as a storeroom, including embedding a heater having a plurality of divided heater wire portions in the heat insulating layer, causing end lead wires connected to both ends of the heater wire and an intermediate lead wire that connects the divided heater wire portions to be led out of the heat insulating layer, connecting the lead wires to a connection section of a control substrate that controls the heater and connecting the heater wires in parallel or in series in a wiring pattern formed on the control substrate.

By dividing the heater capacity (heater wire) and changing connections according to a supply voltage specification in this way, it is possible to use a common heater for both supply voltages of a 100 V system and a 200 V system, suppress management cost and reduce production loss due to misconnections.

Advantageous Effects of Invention

As described above, according to the present invention, the heater capacity (heater wire) is divided and the divided heater wire portions are connected together outside the heater, and it is thereby possible to change the connection mode according to a supply voltage and suppress the heater temperature to within a safe range even in continuous current conduction mode. Therefore, it is possible to use a common heater for any supply voltage specification and suppress management cost, and since heater wires are connected together outside the heater, it is possible to reduce production loss due to misconnections.

DESCRIPTION OF EMBODIMENTS

Figure 4:
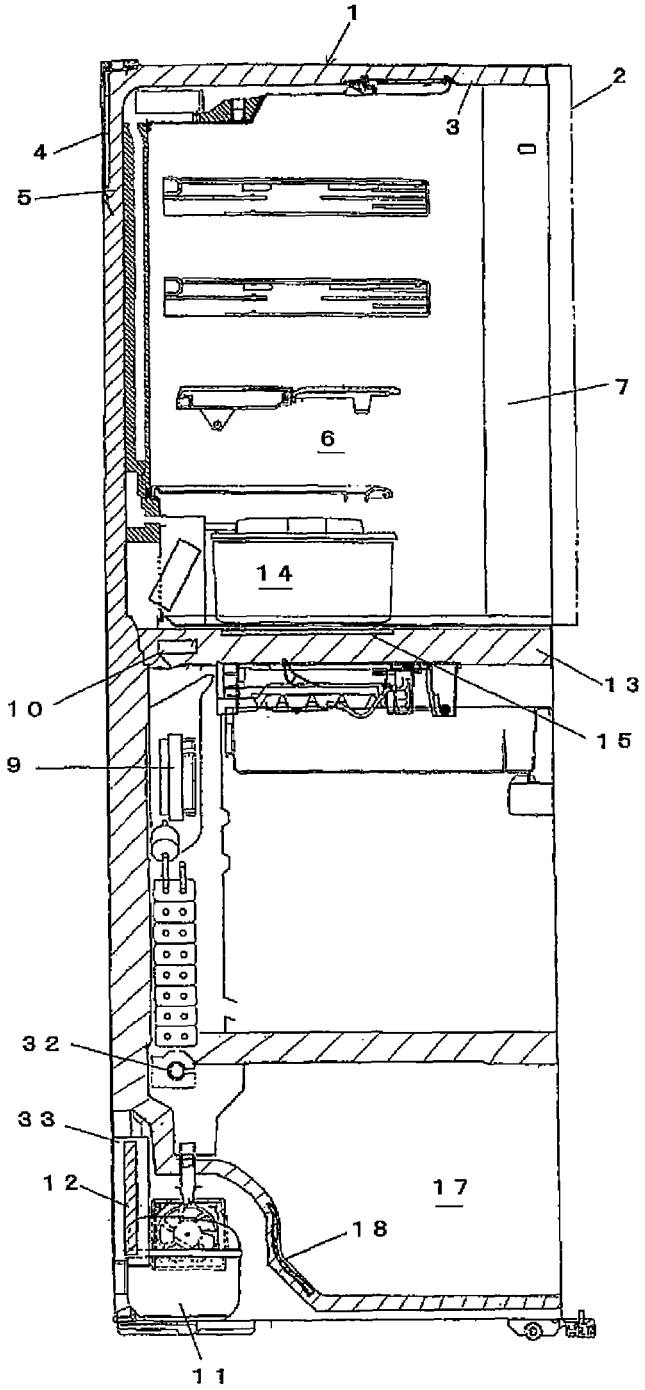
FIG. 4 is a cross-sectional view of a refrigerator illustrating various heater connections.

An embodiment in which a heater apparatus according to the present invention is applied to a refrigerator will be described with reference to the accompanying drawings. As shown in FIG. 4, a refrigerator is constructed of a cabinet 1 and a door 2. In the cabinet 1, a space is formed between an inner box 3 formed through vacuum molding and a metal outer wall 4 as an outer box arranged so as to surround the outside of the inner box 3, a urethane foam heat insulator that is made to foam by chemical reaction is injected into this space and the urethane foam heat insulator is made to foam and a foamed heat insulating layer 5 is formed in and filling the space. As a result, a storeroom 6 having insulating wall surfaces that surround the three sides is formed inside the inner box 3.

As shown in FIG. 4, the storeroom 6 in the present embodiment is made up of three rooms; a cold room on a top row, a freezing room on a middle row and a vegetable room on a bottom row. An opening 7 of the storeroom 6 is covered with the door 2, provided in a freely openable/closable manner, which is formed in the same way as described above and the interior of which is filled with a foamed urethane heat insulator.

Furthermore, many electrical components are arranged in the storeroom 6 such as various temperature sensors that detect a temperature of each part of the storeroom 6 and detect completion of defrosting, a fan 9 that blows cold air into the storeroom 6 and a damper 10 for adjusting the amount of cold air blow. These electrical components are connected to a control substrate 12 via lead wires (not shown). The electrical components output a signal to the control substrate 12 or are driven and controlled by a command from the control substrate 12.

A compressor 11 that constitutes a refrigerant cycle is arranged in a space formed on the rear side of a vegetable room 17 and on the rear side of and outside the heat insulating layer 5 of the cabinet 1. An electrical component box 33 is provided in this space and the control substrate 12 is accommodated in this electrical component box 33.

Furthermore, a freezing prevention heater 15 of a water supply tank 14 is embedded in a partition 13 between the cold room and the freezing room on the urethane foam heat insulating layer side. Furthermore, a temperature compensation heater 18 is embedded on the heat insulating layer side of the vegetable room 17 on the bottom row. These freezing prevention heater 15 and temperature compensation heater 18 are embedded in the heat insulating layer 5 when the cabinet 1 is formed and designed not to be removable after the heat insulating layer is molded. Therefore, in this embodiment, the foamed heat insulating layer 5 can be illustrated as an exterior member in which the heater 18 is embedded, and without the destruction of which the heater 18 cannot be extracted. A defrosting heater 32 for defrosting a refrigerant cycle evaporator is arranged below the evaporator in the cooling room on the rear side of the vegetable room.

Figure 1:
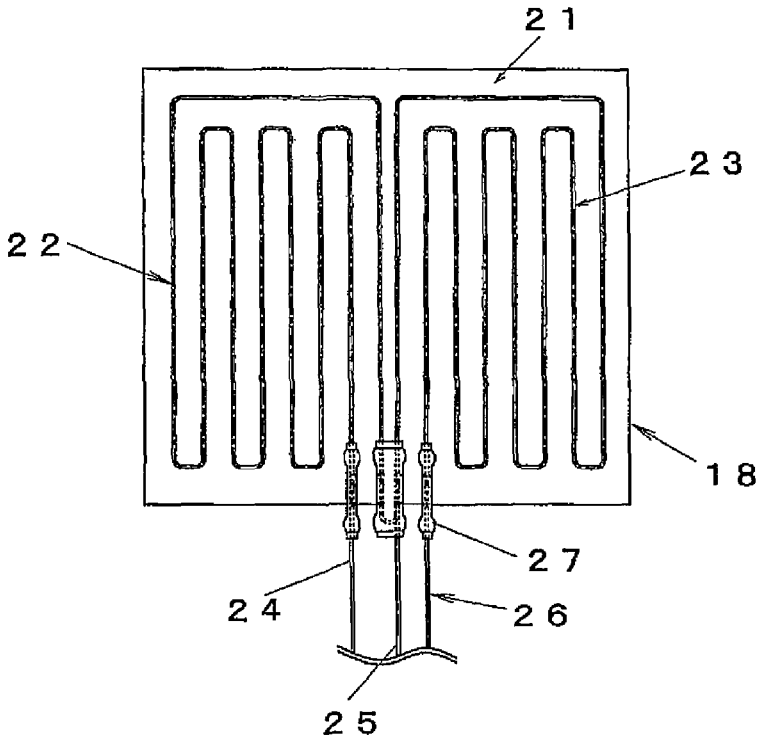
FIG. 1 is a plan view illustrating an aluminum foil heater of a refrigerator.

FIG. 1 is an example of the temperature compensation heater. This heater 18 is a plane heater made up of heater wires 22 and 23 arranged on a metal foil 21 in a predetermined pattern at a predetermined wattage density. The heater wires 22 and 23 are formed by coating the circumference of a nichrome wire coil with an insulator of PVC (polyvinyl chloride) or the like and arranged in a predetermined pattern such as a serpentine pattern.

Figure 2:
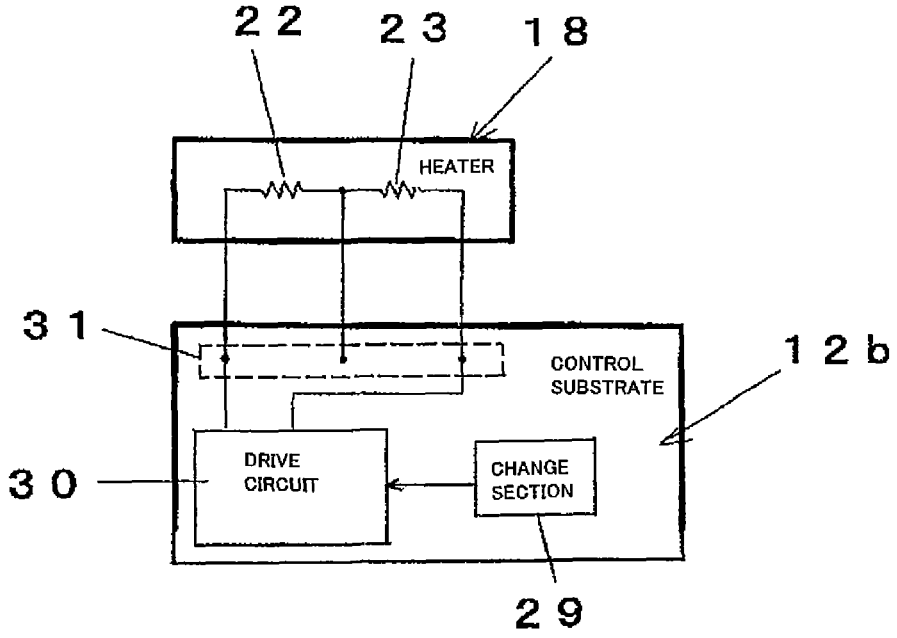
FIG. 2 is a diagram illustrating two heater wires connected in series in a control substrate.
Figure 3:
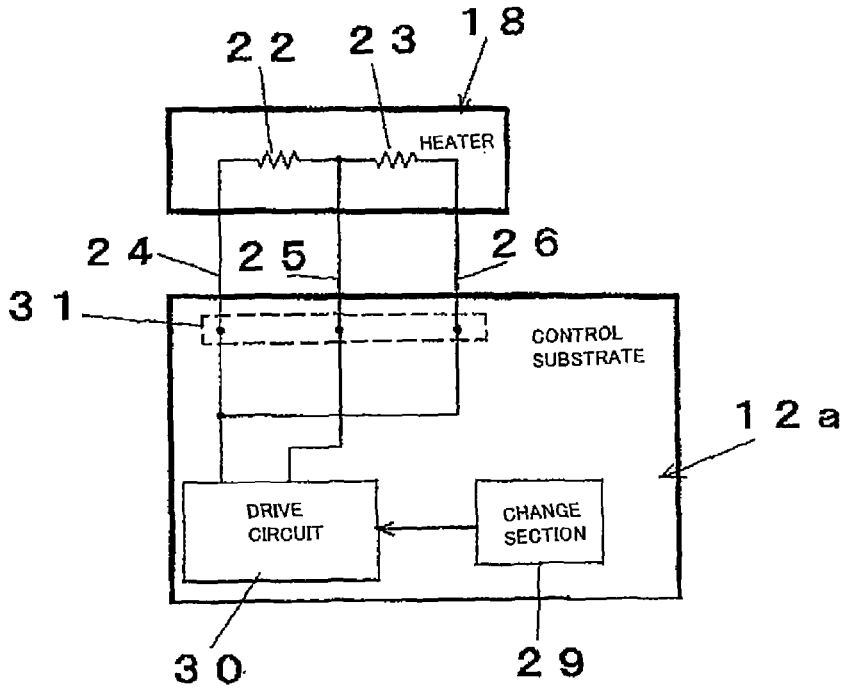
FIG. 3 is a diagram illustrating two heater wires connected in series in a control substrate.

The heater wires 22 and 23 are divided by two at an intermediate position and configured of a first heater wire 22 and a second heater wire 23. The first heater wire 22 and the second heater wire 23 divide the capacity of the heater 18 by half. These heater wires 22 and 23, and the divided portions of both heater wires are connected to lead wires 24, 25 and 26 and hermetically sealed with an insulating member 27. As shown in FIG. 2 and FIG. 3, these lead wires 24, 25 and 26 are connected to a connection section 31 of the control substrate 12 that controls the heater 18. The three lead wires 24, 25 and 26 are bundled to a central part of the heater 18 so as to facilitate connections with the control substrate 12.

The metal foil 21 is an aluminum foil and bonded to the heater wires 22 and 23 by means of a pressure sensitive adhesive double coated tape or adhesion. It goes without saying that a silicon heater may also be used instead of the aluminum foil heater. The heater 18 is constructed of the metal foil 21 and the heater wires 22 and 23. Therefore, the metal foil 21 does not correspond to the exterior member of the present invention in the present embodiment.

A wire harness having a connector at a distal end thereof can be used for the lead wires 24, 25 and 26. The connector can be detachably connected to the connection section 31 of the control substrate 12.

Such a wire diameter of the lead wires 24, 25 and 26 is adopted that allows a sufficient current to flow irrespective of which of a 100 V system supply voltage of 100 V to 127 V or a 200 V system supply voltage of 200 V to 240 V is used. Since the lead wires 24, 25 and 26 may obstruct the flow of the urethane foam that forms the heat insulating layer and may form voids (hollow parts), the lead wires 24, 25 and 26 are made to creep the urethane heat insulator side of the inner box as much as possible. A wire harness having a connector at a distal end thereof can be used for the lead wires 24, 25 and 26 to improve the wiring operation. The distal end connector of this wire harness is connected to the connector provided in the connection section 31 of the control substrate 12 outside the box.

The control substrate 12 is arranged outside the heat insulating layer 5 of the cabinet 1. In the present embodiment, as shown in FIG. 4, the electrical component box 33 is arranged in the space formed on the rear side of and outside the vegetable room and the control substrate 12 is placed in this electrical component box. A wiring pattern for connecting bipartite portions of the heater wire 18 in parallel or in series is formed on the control substrate 12 as shown in FIG. 2 and FIG. 3. The connection section 31 of the control substrate 12 has a connector to allow connections with the lead wires. Furthermore, a heater drive circuit 30 and a power supply circuit (not shown) are connected to the control substrate 12.

The control substrate 12 provides a wiring pattern that differs from one supply voltage specification to another. For example, the control substrate 12 provides a first control substrate 12*a* (see FIG. 3) having a wiring pattern in which heater wires are connected in parallel and a second control substrate 12*b* (see FIG. 2) having a wiring pattern in which heater wires are connected in series.

FIG. 2 shows the wiring pattern of the control substrate 12*b* used when the supply voltage in the destination of the refrigerator is 200 V to 240 V (200 V system) in which the two heater wires are connected in series. FIG. 3 shows the wiring pattern of the control substrate 12*a* used when the supply voltage in the destination of the refrigerator is 100 V to 127 V (100 V system) in which the two heater wires are connected in parallel. Which of the control substrate 12*a* or 12*b* to use may be determined according to the supply voltage specification.

A wiring pattern for connecting a plurality of heater wires in parallel is formed on the first control substrate 12*a* as shown in FIG. 3, the end lead wires 24 and 26 connected to both ends of the heater wire and the intermediate lead wire 25 for connecting the divided heater wire portions outside the heater are connected to the connection section 31 of the first control substrate 12*a*, and the divided heater wire portions are connected in parallel. The first control substrate 12*a* is used for a supply voltage 100 V to 127 V (100 V system).

A wiring pattern for connecting a plurality of heater wires in series is formed on the second control substrate 12*b* as shown in FIG. 2, the end lead wires 24 and 26 connected to both ends of the heater wire and the intermediate lead wire 25 for connecting the divided heater wire portions outside the heater are connected to the connection section 31 of the second control substrate, and the divided heater wire portions are connected in series. The second control substrate 12*b* is used for a supply voltage 200 V to 240 V (200 V system).

Furthermore, a change section 29 that changes a current conduction rate of the heater is provided for each of the first control substrate 12*a* and the second control substrate 12*b* and this change section 29 adjusts the heating value of the heater. The change section 29 is constructed of a general microcomputer made up of a CPU, RAM and ROM, and controls the drive circuit 30 so as to change the current conduction rate of the heater. The current conduction rate of the heater is changed by adjusting the current conduction time. For example, a 20% drive is achieved by repeating two seconds ON/eight seconds OFF in a 10-second cycle. Furthermore, the drive is changed to a 70% drive by repeating seven seconds ON/three seconds OFF in a 10-second cycle. The current conduction rate is changed by sequence control in the change section 29. Therefore, the current conduction rate is controlled at a heater current conduction rate specific to each control substrate 12. The freezing prevention heater 15 also has a configuration similar to that of the temperature compensation heater 18.

In the above configuration, the freezing prevention heater 15 and the temperature compensation heater 18 are embedded in the heat insulating layer 5 as the exterior member during foaming and molding of the cabinet 1. In this case, the end lead wires 24 and 26 connected to both ends of the heaters 15 and 18, and the intermediate lead wire 25 connecting the divided heater wire portions are led out of the heat insulating layer 5.

Next, these lead wires 24, 25 and 26 are connected to the connection section of the control substrate 12*a* or 12*b* that controls the heaters 15 and 18, and the heater wires are connected in parallel or in series through the wiring pattern formed on the control substrates 12*a* and 12*b*.

For example, in the case of a supply voltage 100 V to 127 V (100 V system), the first control substrate 12*a* is used and the heater wires 22 and 23 are connected in parallel as shown in FIG. 3. In this case, a total resistance value R of the heater is expressed as (1/R)=(1/R1)+(1/R2), where resistances of the heater wires 22 and 23 are R1 and R2 respectively. When R1=R2=10 KΩ, for example, $1/R=1/10+1/10=2/10$, therefore R=5 KΩ. When the supply voltage is 100 V, a total current value Ic is Ic=100 V/5 KΩ=0.02 ampere (A). Wattage is 100 V×0.02 A=2 W.

In the case of a supply voltage 200 V to 240 V (200 V system), the second control substrate 12*b* is used, the heater wires are used in series connection as shown in FIG. 2. In this case, a total resistance value R of the heater is expressed as R=R1+R2, where resistances of the heater wires 22 and 23 are assumed to be R1 and R2 respectively. Similarly when R1=R2=10 KΩ as described above, the total resistance value R is R=10+10=20 KΩ. When the supply voltage is 200 V, the total current value Ic is Ic=200 V/20 KΩ=0.01 ampere (A). Wattage is 200 V×0.01 A=2 W.

If the heater wires 22 and 23 are connected in parallel at a 200 V system supply voltage, the total resistance value R is $1/R=1/10+1/10=2/10$, therefore R=5 KΩ, whereas if the supply voltage is 200 V, the total current value I is I=200 V/5 KΩ=0.04 ampere (A). Therefore, wattage (W) is 200 V×0.04 A=8 W.

By dividing the heater capacity (heater wire) and changing between series connection and parallel connection according to the supply voltage specification in this way, it is possible to use a common heater, for example, for both supply voltages of the 100 V system and 200 V system, suppress management cost and reduce production loss due to misconnections.

The present invention is not limited to the above embodiment, and it goes without saying that a number of modifications or alterations can be made without departing from the scope of the present invention. For example, the above embodiment has described the connections of the freezing prevention heater 15 and the temperature compensation heater 18 of the refrigerator, but the present invention is not limited to these, and as descried above, the present invention is also applicable to heater apparatuses of other electric apparatuses such as a hot carpet and floor heating appliances. Examples of the exterior member in this case may include a heat insulating member of a hot carpet or floor heating appliances.

REFERENCE SIGNS LIST

1 Cabinet
2 Door
3 Inner box
4 Metal outer wall
5 Heat insulating layer
6 Storeroom
7 Opening
9 Fan
10 Damper
11 Compressor
12 Control substrate
13 Partition
15 Freezing prevention heater
18 Temperature compensation heater
21 Metal foil
22, 23 Heater wire
24, 25, 26 Lead wire
29 Change section
30 Drive circuit
31 Connection section

The invention claimed is:

1. A heater apparatus assembly method for a refrigerator having a heat insulating box that includes a heat insulating layer filling a space formed of an inner box and an outer wall and uses the interior of the inner box as a storeroom, and a heater including a heater wire embedded in the heat insulating layer, the method comprising:

dividing the heater wire into a plurality of heater wires;

connecting one end of each heater wire to end lead wires, connecting the other end of each heater wire to an intermediate lead wire, and causing the end lead wires and the intermediate lead wire to be led out of the heat insulating layer;

when connecting the heater wires in parallel according to a supply voltage, using a first control substrate having a wiring pattern in which the plurality of heater wires is connected in parallel, and connecting the divided heater wires in parallel by connecting the end lead wires led out of the heat insulating layer and the intermediate lead wire to a connection section of the first control substrate; and when connecting the heater wires in series according to a supply voltage, using a second control substrate having a wiring pattern in which the plurality of heater wires is connected in series and driving and controlling the heater, and connecting the divided heater wires in series by connecting the end lead wires led out of the heat insulating layer and the intermediate lead wire to the connection section of the second control substrate.

2. The heater apparatus assembly method for a refrigerator according to claim 1, wherein a change section changing a current conduction rate of the heater is provided for the outside of the heat insulating layer, the change section adjusting the heating value of the heater.

* * * * *